United States Patent [19]

Adams

[11] Patent Number: 4,616,589

[45] Date of Patent: Oct. 14, 1986

[54] ANCHOR RETRIEVAL MECHANISM

[75] Inventor: Truman W. Adams, Indianapolis, Ind.

[73] Assignee: Anchors, Inc., Indianapolis, Ind.

[21] Appl. No.: 597,361

[22] Filed: Apr. 6, 1984

[51] Int. Cl.[4] ..... B63B 21/22

[52] U.S. Cl. ..... 114/210

[58] Field of Search ..... 114/210, 298, 305, 343; 267/71, 74

[56] References Cited

U.S. PATENT DOCUMENTS

| | | | |
|---|---|---|---|
| 3,007,239 | 11/1961 | Lermont | 267/74 |
| 3,635,187 | 1/1972 | Webb | 114/210 |
| 3,675,608 | 7/1972 | Webb | 114/210 |
| 4,057,024 | 11/1977 | Adams | 114/298 |
| 4,148,465 | 4/1979 | Bowman | 114/343 |

*Primary Examiner*—Trygve M. Blix
*Assistant Examiner*—Jesûs D. Sotelo
*Attorney, Agent, or Firm*—Woodard, Weikart, Emhardt & Naughton

[57] ABSTRACT

An anchor retriever for deploying an anchor from a boat into the water and for retrieving the anchor from the water includes a base portion having a metal plate for attachment directly to the boat and a synthetic material guide providing a sliding channel arrangement for a movable carriage. Pivotally attached to the movable carriage is an anchor retention assembly which provides the actual anchor holder portion which pivots from a substantially horizontal to a substantially vertical orientation as the anchor goes from a stowed orientation to a deployed orientation into the water. When the anchor is retrieved it applies force on certain portions of the retriever assembly, these portions are then allowed to come out of locking engagement whereby the anchor retention assembly pivots from its vertical orientation to its horizontal orientation as it goes from a deployed condition to a stowed condition. A pair of stops disposed as part of the base portion controls the movement of the movable carriage which is spring-biased relative to the base portion.

19 Claims, 7 Drawing Figures

ANCHOR RETRIEVAL MECHANISM

BACKGROUND OF THE INVENTION

The present invention relates in general to release and retrieval machanisms for anchors of the type frequently used with fishing and pleasure boats. More particularly, the present invention relates to an anchor release and retrieval mechanism for use with a releasable anchor, such as that disclosed in my earlier U.S. Pat. No. 4,057,024 which issued Nov. 8, 1977.

One of the more tedious tasks with boating, especially fishing, is the repetitive process of lowering and then retrieving the anchor. Since fisherman frequently change fishing spots, depending on where the fish are "hitting" and depending upon the various tides and currents, 4–5 hours of fishing may involve as many as 8–12 changes in location. Even if one is only pleasure boating and anchoring at a location for an extended period of time, the lack of any convenient and safe way to retain the anchor until it is lowered into the water makes the present invention particularly significant.

With the size or class of boat to which the present invention pertains, the anchors which are typically used include a central shank or body portion which is surrounded at the distal end by outwardly radiating and evenly spaced anchor arms. This type of anchor is usually located at the bow of the boat and merely rests, with its anchor cable, on some portion of the boat until it is tossed into the water. There is typically no way to stow or conceal the anchor and it is thus loose and allowed to move or shift position as the boat maneuvers through the water and is tossed by the waves. The outwardly radiating anchor arms also represent an undesirable situation in that they are open and exposed.

One drawback with this type of anchor is how to release the anchor arms when they become lodged on an obstruction in the bottom of the body of water. This particular difficulty was overcome by my earlier invention disclosed in what is now U.S. Pat. No. 4,057,024, wherein a means is provided to collapse the arms when they become lodged. Another drawback, the lack of any means to safely retain and stow the anchor when it is out of the water, is overcome by the present invention. While the present invention provides a novel and unobvious release and retrieval mechanism, the design disclosed also provides a stowage feature not heretofore available in the same form. Finally, the present invention when used in combination with the style of anchor according to my earlier U.S. Pat. No. 4,057,024, provides the above benefits as well as a novel means to collapse the anchor arms so that when the anchor is fully retrieved and retained by the present invention, the arms are folded along side the shank of the anchor so as to provide a more streamlined and unobstructing stowed configuration.

The present invention provides a novel and unobvious mechanism which is mounted to an internal surface of the boat which is adjacent an outer edge of the boat. Due to a spring biasing arrangement, release of the anchor cable winch allows the anchor and its holder to be pulled out over the edge of the boat by the spring force. Once this occurs, the anchor arms are free to expand outwardly as they unfold and as the anchor is lowered into the water. As the winch continues to unwind, more anchor cable is made available and the anchor sinks to the bottom of the body of water. The retrieval process is effectively the reverse of the deployment cycle wherein the winch begins to wrap up the anchor cable drawing the anchor out of the water, and once properly received by the present invention is allowed to pivot so as to flip up over the side of the boat, changing from a substantially vertical orientation to a substantially horizontal orientation, in order for the anchor to be stowed.

SUMMARY OF THE INVENTION

An anchor retrieval mechanism for deploying an anchor from a boat into the surrounding water and for retrieving the anchor from the water according to one embodiment of the present invention comprises a base portion adapted for attachment to the boat, a movable carriage slidably received on the base portion, stop means cooperatively arranged relative to the base portion and the movable carriage so that the carriage is movable between a first stop location and a second stop location, and an anchor retention assembly pivotally attached to the movable carriage and movable between an anchor stowed orientation which corresponds to the first stop location and an anchor deployed orientation which corresponds to the second stop location.

One object of the present invention is to provide an improved anchor retrieval mechanism.

Related objects and advantages of the present invention will be apparent from the following description.

DESCRIPTION OF THE PREFERRED EMBODIMENT

Figure 1:
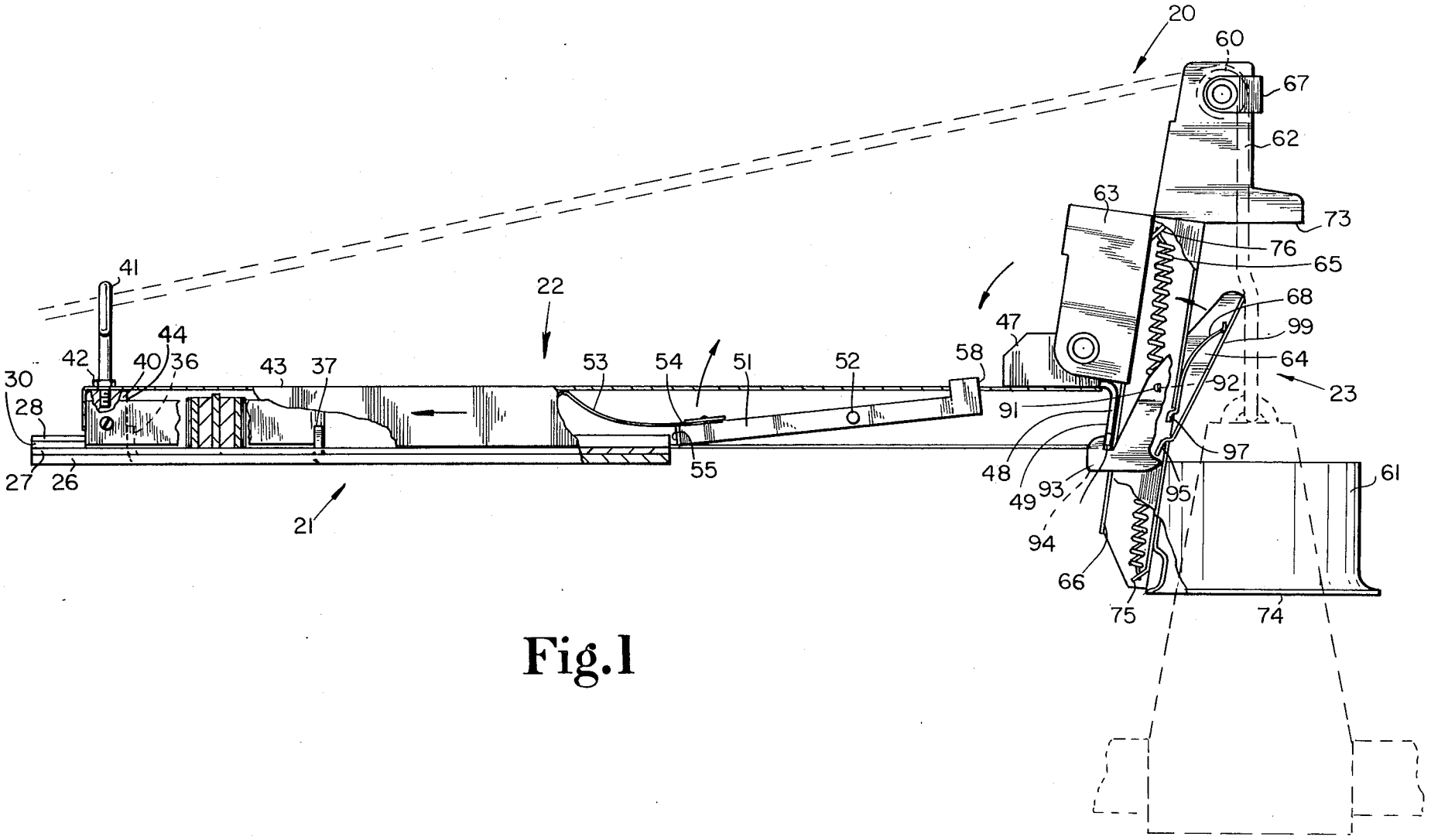
FIG. 1 is a fragmentary, side elevation view of an anchor retrieval mechanism according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
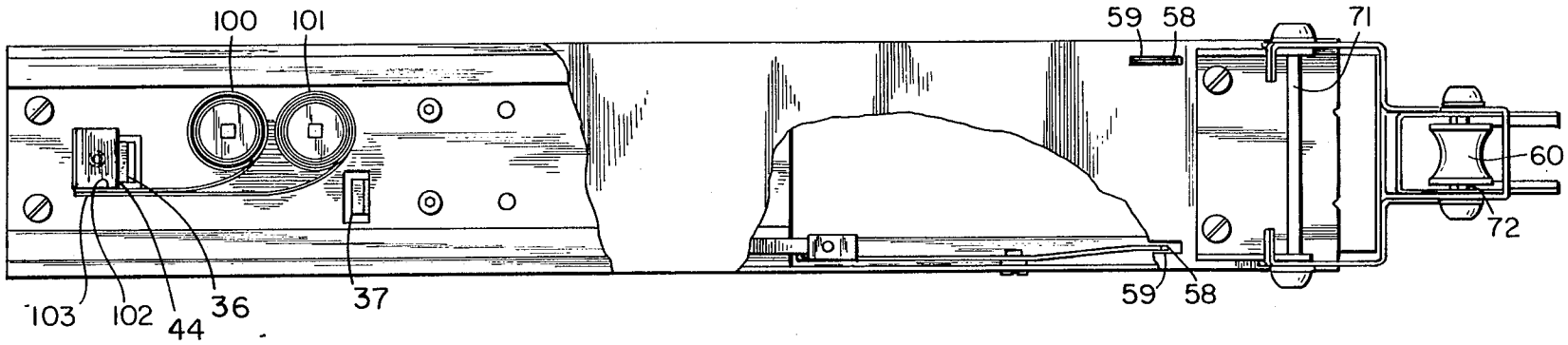
FIG. 2 is a fragmentary top plan view of the FIG. 1 anchor retrieval mechanism.
Figure 3:
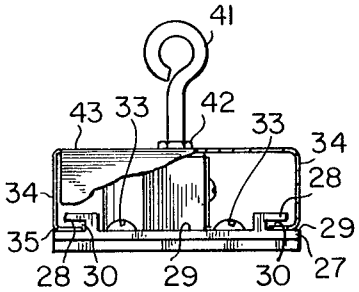
FIG. 3 is a fragmentary end elevation view of the FIG. 1 anchor retrieval mechanism.

Referring to FIGS. 1, 2 and 3, there is illustrated an anchor retrieval mechanism 20, hereinafter referred to as "retriever," which includes a base portion 21, movable carriage 22, and anchor retention assembly 23. Base portion 21 includes a metal attachment plate 26 and a synthetic material guide 27 which are designed to mount directly to a flat portion of the boat's bow or hull. A series of clearance holes is provided for attaching the attachment plate 26 and guide 27 to the boat by means of screws 33. The synthetic material guide 27 provides a pair of outwardly extending longitudinal ribs 28 which in turn define in combination with top surface 29 carriage-receiving longitudinal channels 30. A pair of screws is further used to secure the attachment plate and guide together prior to the assembly of this combination to the boat. As should be understood, both the plate 26 and guide 27 are generally symmetrical about their respective longitudinal centerlines. The use of a synthetic material for guide 27 permits quiet and smooth sliding action thereon by carriage 22.

Slidably received on base portion 21 is a movable carriage 22 which actually locks onto guide 27 by means of channels 30. Carriage 22 includes a formed metal case wherein side portions 34 are bent inwardly at their lower extremity in order to create inwardly directed flanges 35 which slidably fit within channels 30 for interlocked engagement with guide 27. As is intended to be illustrated and as should be understood from the disclosure provided, each of the flanges 35 extend inwardly almost the full depth of their corresponding channel 30 such that the clearance which is left is not sufficient for a full lateral shift of the carriage relative to the guide, in either direction, that would allow the two members to become disengaged. This degree of overlap and thus interlock requires that the carriage and guide be assembled only after first being arranged in and end-to-end relationship. Stops 36 and 37 are provided as part of the attachment plate and extend upwardly through the guide. One stop 36 is positioned in order to control the location of the movable carriage when the anchor is being deployed into the water. The other stop 37 is positioned in order to control the location of the carriage when the anchor is retrieved and stowed. As will be explained hereinafter, the movable carriage is permitted to move to the right, according to the illustration of FIG. 1 as part of the deployment sequence for the anchor which is carried by retriever 20. This movement to the right continues until stop 36 is encountered at which point the anchor is sufficiently beyond the edge of the boat to be lowered into the water. When the anchor is retrieved, it is drawn upwardly and then pulled to the left at which time the movable carriage moves to the left to the location of stop 37. Stop 37 represents that position for the movable carriage when the anchor is in a stowed orientation.

One option, and that disclosed in the illustrated embodiment, for stops 36 and 37 is to punch a pair of rectangular tabs directly in the metal of plate 26 and bend these tabs upwardly through an aligned opening in guide 27. Alternatives include cementing the stops in place, or placing them at their precise location by welding or by screwing the stops into internally threaded holes in plate 26. The important aspect to note though is that two stops are provided at different and spaced apart locations and for different purposes. One corresponds to an anchor-deployed condition while the other corresponds to an anchor-stowed condition. Each stop remains stationary relative to plate 26 and guide 27.

Figure 7:
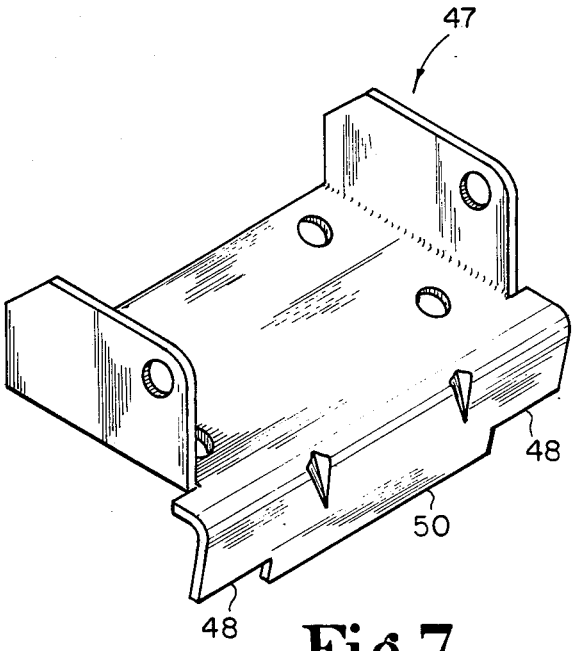
FIG. 7 is a perspective view of a support bracket comprising a portion of the FIG. 1 anchor retrieval mechanism.

Disposed at one end of the movable carriage is an abutment block 40 which is secured in place by bolt 41 and jam nut 42. Block 40 has an internally threaded hole for receipt of the threaded end of the eyebolt which extends through an opening in top surface 43 of the movable carriage. Nut 42 locks the bolt in place. Block 40 extends downwardly toward guide 27 a sufficient distance so that abutment surface 44 is in position to contact and abut against stop 36 thereby blocking the movable carriage in that position from further movement relative to the base portion. At the opposite end of the carriage there is assembled a double-flanged support bracket 47 (see FIG. 7) which is secured to top surface 43 by a plurality of threaded fasteners. Double-flanged support bracket 47 includes a formed lower portion 48 which is notched out on both sides and extends downwardly across end 49 of the carriage. The central unnotched section 50 serves as an interlocking edge for part of the anchor retention assembly 23 as will be described in greater detail hereinafter.

Intermediately positioned between block 40 and bracket 47 is a pair of spring-biasing release levers 51 (one on each side of carriage 22), which are pivotally secured to their corresponding carriage side by pivot pins 52. The spring-biasing on each side is provided by a spring 53 formed as a curved rectangular strip of spring steel which is attached at one end to lever 51 at surface 54 and from there extends in a concave manner toward the underside of the top surface 43 against which it abuts. As can be seen, end 55 is unable to move farther to the left when in the present orientation because of its abutment against the end of ribs 28 and thus the carriage is "locked" in the anchor-deployed orientation of FIGS. 1, 2 and 3 by the position of the release levers relative to the base portion.

On the opposite side of each pivot pin 52, the other end 58 of each lever 51 projects upwardly through a corresponding clearance spot 59. End 58 (of each lever) is biased in this orientation by the nature of the vector forces transmitted from the spring 53 through its corresponding lever. In order to change the relative position of the carriage with respect to the base portion, it is necessary to depress end 58 a sufficient distance to raise end 55 out of its abutting relationship to the end of the base portion. This depression is accomplished by the counterclockwise pivoting action of the anchor retention member 23 as retriever 20 is changed from an anchor-deployed orientation to an anchor-retrieved and stowed orientation.

In the illustrated orientation of FIGS. 1, 2 and 3, the carriage snaps into a locked orientation slightly before block 40 reaches stop 36. The dimensions and spacing of the disclosed design assure that lever 51 passes beyond the end of the base portion before the block reaches the stop so that even in a worse case of tolerance and dimensional stacks, there will be a fully locked condition prior to abutment of block 40 against stop 36. Additional clearance for free pivoting of lever 51 about pin 52 is provided by the offset shape of lever 51 to the right of the pivot pin (see FIG. 2).

The anchor (shown in broken-line form) with which retriever 20 is used is secured to a winch (not illustrated) by means of an anchor cable (shown in broken-line form) which extends through the eye of eyebolt 41 across pulley 60 and downwardly through sleeve 61. The preferred anchor style for use with retriever 20 is that style disclosed by my prior U.S. Pat. No. 4,057,024 which issued Nov. 8, 1977 and which is hereby incorporated by reference into this disclosure for its disclosure and teachings of a particular anchor style with releasable anchor arms. While the anchor style of my earlier patent is the type to which the present description is directed, the present invention is applicable to virtually any style of boat anchor.

Pulley 60 and sleeve 61 are part of the anchor retention assembly which additionally includes top member 62, pivot release bracket 63, release latch 64, spring 65, support plate 66, bar 67 and spring 68. These various component parts are assembled together in the manner illustrated wherein bracket 63 is hinged to support bracket 47 by pin 71 and is free to pivot about the longitudinal axis of the pin in both clockwise as well as counterclockwise directions, depending on whether the anchor is being lowered or retrieved. Top member 62 supports pulley 60 by means of pin 72 while bar 67 assures that the anchor cable remains properly wrapped about the pulley. An anchor abutment surface 73 is arranged as part of the top member and when the top of the anchor pushes against this surface during the anchor retrieval procedure, spring 65 is stretched slightly thereby effectively increasing the relative distance between surface 73 and the bottom edge 74 of sleeve 61. This effective increase in length is important in order to allow the anchor arms to fold downwardly thereby reducing the diameter size of the anchor as the anchor moves farther upwardly into sleeve 61. This particular feature of the present invention will be described in greater detail hereinafter; however, it is important to note that the presence of spring 65 and the sliding relationship between surface 73 and edge 74 permits this increase in length in a controlled and force-balanced manner.

Sleeve 61 is rigidly attached to the outer and lower surface of bracket 63 while bracket 63 provides spring tab 75 which inserts into one closed-loop end of spring 65. Top member 62 provides the opposite spring tab 76 for the opposite closed-loop end of spring 65, and since bracket 63 is secured (pinned) to the carriage while the top member is movable, a force against surface 73 (such as by abutment of the anchor shank) causes the distance between the two tabs to increase thereby stretching spring 65. When the anchor is released, the abutment force against surface 73 is removed and the spring force returns the anchor retention assembly to the orientation illustrated by FIGS. 1, 2 and 3.

Figure 4:
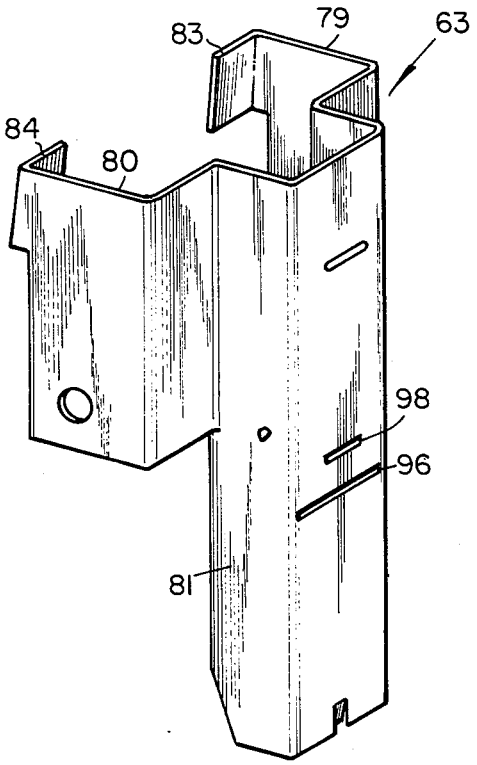
FIG. 4 is a perspective view of a bracket member comprising a portion of the FIG. 1 anchor retrieval mechanism.

Referring to FIG. 4, bracket 63 is illustrated in detail showing formed sides 79 and 80 with central tongue 81. It is the lower portion of tongue 81 that is punched out in order to provide the metal tab for spring tab 75. The cross-sectional size of tongue 81 is closely dimensioned so as to receive a matching tongue portion 82 of top member 62 (see FIG. 5). Another important portion of bracket 63 is the abutment flanges 83 and 84 which are oppositely and symmetrically positioned relative to the longitudinal centerline of the bracket.

Figure 5:
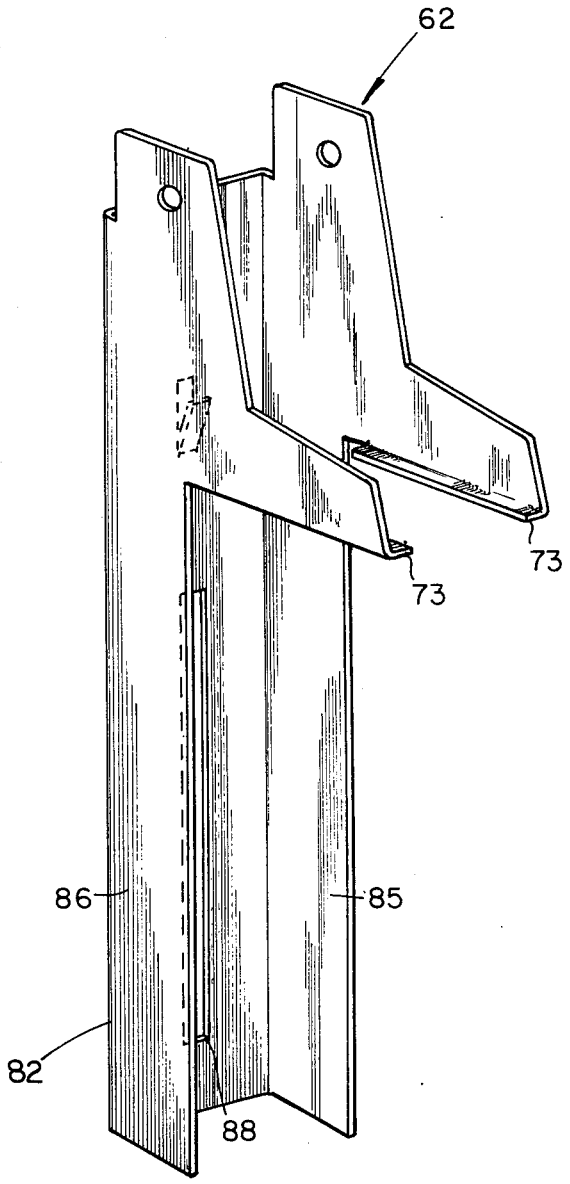
FIG. 5 is a perspective view of a top member comprising a portion of the FIG. 1 anchor retrieval mechanism.
Figure 6:
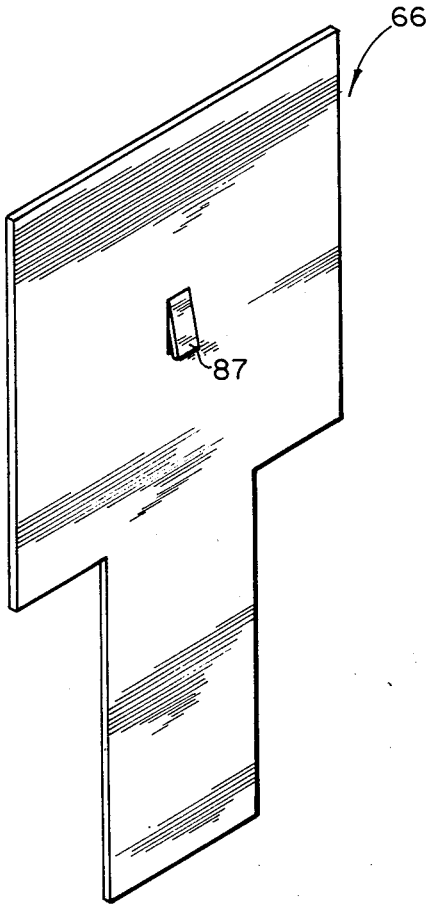
FIG. 6 is a perspective view of a plate member comprising a portion of the FIG. 1 anchor retrieval mechanism.

Referring to FIG. 5, top member 62 is illustrated in greater detail showing sides 85 and 86 with tongue portion 82 whose cross-sectional area is of a size sufficient to fit within tongue 81. The engagement of these two tongues creates an enclosed channel whose lateral cross-sectional area is substantially square. Within this enclosed channel, spring 65 is positioned and is assembled over the two spring tabs. Spring 65 extends for substantially the full length of the enclosed channel. Plate 66 fits within the central clearance space of bracket 63 and is welded thereto and provides a substantially flat sliding surface against which the top member moves as the anchor is retrieved and deployed as previously described. Protruding tab 87 acts as a positive stop when it abuts against the end of slot 88 when top member 62 is at full extension.

The final major part of the anchor retention assembly is latch 64 which snaps into position by means of opposite side protrusions 91 and 92 which interlock with corresponding and matching formations on bracket 63. Notched side flanges 93 and 94 snap into position behind unnotched section 50 of the support bracket 47 after the anchor has been released and before it is retrieved. Formed tab 95 fits within slot 96 of bracket 63 for pivotal movement of the latch relative to the bracket. Spring 68 is formed with an offset end 97 which fits within slot 98 of bracket 63. Spring 68 acts against the inside surface of latch 64 such that as the latch is pivoted in a counterclockwise direction toward bracket 63, the spring force increases as the notched flanges 93 and 94 pivot out of interlocked engagement with unnotched section 50.

The orientation of retriever 20 as illustrated in FIGS. 1, 2 and 3 is the position with the anchor deployed in the water. In this position, the anchor retention assembly is locked in a substantially vertical orientation, and is substantially perpendicular to the longitudinal centerline plane of the base portion 21. Also in this position end 58 of each lever is raised above top surface 43 and the movable carriage is shifted to the right to the point of abutment against stop 36 by means of block 40. Using an anchor of the type disclosed in my U.S. Pat. No. 4,057,024, there is provided a tapered and elongated body or shank which is hollow and which carries a rod with a loop end to which the anchor line or anchor cable is tied. As the winch is wound causing the anchor line to wrap around its internal pulley or spool, the anchor is pulled out of the water in the direction of sleeve 61. As the shank portion of the anchor is pulled upwardly through the sleeve and as the upper portion contacts the outwardly and upwardly inclined surface 99 of latch 64, it pushes the latch in a counterclockwise direction and at this time frees the notched flanges of the latch enabling it to be moved out of the way of the upwardly advancing anchor.

As long as the anchor is occupying the space between surface 73 and sleeve 61, latch 64 remains pushed out of the way in the counterclockwise direction and the anchor retention assembly is free to move. With continued advancement of the anchor during the retrieval process, surface 73 which is in the form of two spaced apart yet parallel edges with a clearance space therebetween, acts as an abutment surface for the advancing anchor. The upward force on surface 73 by the anchor causes the anchor retention assembly to pivot about pin 71 in a counterclockwise direction relative to the orientation provided in FIG. 1. This counterclockwise rotation continues until the anchor retention assembly becomes substantially horizontal and immediately preceding this horizontal orientation, flanges 83 and 84 each push downwardly on their corresponding lever ends 58 disengaging the carriage relative to the base portion. With the anchor retention assembly horizontal and the anchor's top end being pulled against surface 73 by the anchor cable, the carriage is able to move to the left as the anchor winch continues to wrap the anchor cable.

This movement to the left continues until the unnotched section 50 of support bracket 47 abuts against stop 37. At this point the movable carriage and base portion can no longer move relative to each other due to the abutment against stop 37 and this orientation represents the anchor retrieved condition as between the base portion and the movable carriage. However, due to the ability to effectively increase the length between surface 73 and bottom edge 74, by spring action, the anchor retention assembly is not yet in its fully stowed condition. Although the anchor could be left in this particular orientation, the anchor arms are outwardly extended and it is believed preferred to collapse those arms so as to provide a more compact and streamlined anchor shape while it is stowed and retained by the retrieval mechanism of the present invention. This anchor arm collapsing technique for full stowage will be described hereinafter.

Rigidly secured to the base portion is a pair of coiled springs 100 and 101 which are made from spring steel bands coiled about a central pivot point and designed so as to uncoil as their free end is pulled outwardly from the pivot point and then automatically recoil when the force on the free end is less than the spring force created by the uncoiling. This style of spring is generally referred to as a constant-force spring. The free ends 102 and 103 of each coiled spring are attached to block 40. When block 40 is against stop 36, both coiled springs are wound up to their maximum in the present invention and thus the length between the pivot point and the free end is at its shortest distance. As carriage 22 moves to the left, as the anchor is retrieved, the free end of each coiled spring is pulled upon thus unwinding each of the coiled springs and the spring force remains constant as the uncoiling continues. Once the anchor is fully retrieved and stowed, carriage 22 is moved to its farthest extent, to the location where stop 37 is encountered, and the spring extension is at its maximum in the present application.

Release of the anchor winch is an act that would normally allow the weight of the anchor to pull on the anchor cable and cause it to unwind. However, this is not permitted by the present invention, initially, because the anchor is stowed in a substantially horizontal position relative to the base portion. In order for the weight of the anchor to act as part of the unwinding of the anchor cable and deployment into the water, it is necessary to move the anchor laterally to a point beyond the edge of the boat and then turn it so that the forces of gravity can act upon the weight of the anchor. This lateral movement is provided by means of the spring force. Although the presence of stop 37 controls the amount of spring extension, the spring force is acting to pull the movable carriage to the right, but is restrained by the tension on the anchor cable which is now locked around the anchor winch. Release of the winch allows the spring forces to act moving the movable carriage to the right until stop 36 is encountered. The amount of movement which occurs does so "automatically" due to the stored energy within the coiled springs. This energy is sufficient to pull the anchor retention assembly beyond the edge of the boat, at which point the weight of the anchor acting around pulley 60 pivots the mechanism in a clockwise direction allowing the weight of the anchor to return the anchor retrieval mechanism to the orientation of FIGS. 1, 2 and 3.

Another feature of the present invention is particularly adapted for the style of anchor of my U.S. Pat. No. 4,057,024. With this style of anchor, the anchor arms are releasable by applying a pulling force on the central rod as is taught by this prior and incorporated reference. Although this type of anchor is designed to be freed by a sharp jerk on the anchor cable, under normal retrieval conditions the anchor arms are outwardly extended substantially perpendicular to the anchor's central rod. While the retrieved and stowed anchor can be retained with the arms extended as previously mentioned, it is safer and more desirable to collapse the arms in order for the stowed anchor to be in a more compact and streamlined arrangement.

In order to collapse the anchor arms by means of retriever 20, it is necessary to apply a pulling force on the central rod while pushing in the opposite direction on the top portion of the anchor shank by surface 73. With the anchor shank braced by surface 73, and with the winch pulling the rod by way of the anchor cable, the release procedure for the anchor arms begins. After abutment between surface 73 and the anchor shank, the bottom edge 74 of sleeve 61 assists the anchor release procedure which results in collapsing the anchor arms by pushing on the anchor arms. As the arms fold against the anchor body, the anchor is pulled farther upwardly through the sleeve. Since this upward movement is effectively an increase in the length of the anchor as seen by surface 73 relative to edge 74, one of these two surfaces must be able to move relative to the other in order to accommodate this length increase. As previously described relative to the assembly of the anchor retention assembly, the movement of top member 62 which stretches spring 65 permits this effective length increase by actually allowing surface 73 to slide or shift upwardly. The spring provides a balance of the forces acting to pull on the central rod of the anchor relative to the force on the arms by way of edge 74 of sleeve 61. Without the spring, all of the force would be exerted on the anchor arms and the level of such force would be in excess of that considered permissible. By allowing the top portion of the anchor shank to be abutted against and restrained by surface 73, the cable is able to act on the central rod pulling it upwardly relative to the remaining portion of the anchor body. As the central rod is pulled, this assists in allowing the anchor arm to be collapsed.

While this particular feature is only of importance to anchors with the releasable arm feature, it is to be understood that this particular feature is but one portion of the present invention and that the remaining portions previously described as part of the present invention are well suited to all styles of anchors which may be automatically deployed and retrieved by the mechanism which has been described.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An anchor retriever for deploying an anchor from a boat into the water, the anchor being tied to an anchor cable, and for retrieving the anchor from the water by means of said cable, said retriever comprising:

a base portion adapted for attachment to the boat, said base portion includes an attachment plate adapted for attachment to the boat and a guide plate secured thereto, said guide plate providing a pair of oppositely disposed and outwardly opening receiving channels;

a movable carriage slidably received on said base portion;

stop means cooperatively arranged relative to said movable carriage such that the carriage is movable between a first stop location and a second stop location; and an anchor retention assembly pivotally attached to said movable carriage and movable between an anchor-stowed orientation which corresponds to said first stop location and an anchor-deployed orientation which corresponds to said second stop location, said anchor retention assembly includes:

anchor holder means adapted for the anchor cable to pass therethrough;

latch means assembled to said anchor holder means and adapted to interlock with said movable carriage when said anchor retention assembly is in said anchor-deployed orientation; and, pivot attachment means assembled between said movable carriage and said anchor holder means and adapted to allow said anchor holder means to pivot from a first orientation when said anchor retention assembly is in said anchor-deployed orientation to a second orientation which is substantially perpendicular to said first orientation, said second orientation corresponding to said anchor-stowed orientation.

2. The retriever of claim 1 wherein said movable carriage includes a pair of oppositely positioned and inwardly directed flange portions which are adapted to be slidably received by said receiving channels.

3. An anchor retriever for deploying an anchor from a boat into the water, the anchor being tied to an anchor cable, and for retrieving the anchor from the water by means of said cable, said retriever comprising:

a base portion adapted for attachment to the boat;

a movable carriage slidably received on said base portion;

stop means cooperatively arranged relative to said movable carriage such that the carriage is movable between a first stop location and a second stop location;

an anchor retention assembly pivotally attached to said movable carriage and movable between an anchor-stowed orientation which corresponds to said first stop location and an anchor-deployed orientation which corresponds to said second stop location; and said anchor retention assembly includes anchor holder means adapted for the anchor cable to pass therethrough, latch means assembled to said anchor holder means and adapted to interlock with said movable carriage when said anchor retention assembly is in said anchor-deployed orientation, pivot attachment means assembled between said movable carriage and said anchor holder means and adapted to allow said anchor holder means to pivot from a first orientation when said anchor retention assembly is in said anchor-deployed orientation to a second orientation which is substantially perpendicular to said first orientation, said second orientation corresponding to said anchor-stowed orientation.

4. The retriever of claim 3 which further includes spring-biasing means attached between said base portion and said movable carriage and being adapted to move said movable carriage from said first stop location to said second stop location.

5. The retriever of claim 4 wherein said base portion includes an attachment plate adapted for attachment to the boat and a guide plate secured thereto, said guide plate providing a pair of oppositely disposed and outwardly opening receiving channels.

6. The retriever of claim 5 wherein said movable carriage includes a pair of oppositely positioned and inwardly directed flange portions which are adapted to be slidably received by said opposite channels.

7. An anchor and anchor retriever assembly for deploying an anchor from a boat into the water and retrieving the anchor from the water, said assembly including a releasable anchor having a central body portion, releasable outwardly extending arms and a central rod, and an anchor cable secured to said central rod, wherein the improvement comprises:

support means adapted for attachment of the anchor retriever to a portion of a boat, said support means includes an attachment plate designed and arranged for directly attaching to the boat and assembled thereto a guide plate providing a pair of oppositely disposed and outwardly opening channels;

a movable anchor carriage slidably received by said support means and movable between an anchor-deployed orientation and an anchor-stowed orientation, said movable anchor carriage including a pivotal anchor holder which is oriented in a first position when said movable anchor carriage is in said anchor-deployed orientation and in a second position which is substantially perpendicular to said first position when said movable anchor carriage is in said anchor-stowed orientation; and lock means for locking said movable carriage in said anchor deployed orientation, said lock means including a lever and a spring means for biasing said lever in a locking orientation which unidirectionally inhibits relative motion between said movable carriage and said support means when said movable carriage is in said anchor deployed orientation.

8. The assembly of claim 7 which includes stop means providing a first stop location corresponding to said anchor-stowed orientation and spaced apart therefrom a second stop location corresponding to said anchor-deployed orientation.

9. The assembly of claim 8 which further includes spring-biasing means attached between said support means and said movable anchor carriage and being adapted to move said movable anchor carriage from said first stop to said second stop.

10. The assembly of claim 7 wherein said movable anchor carriage includes a pair of oppositely positioned and inwardly directed flange members suitably designed and arranged for cooperative engagement with said channels for providing a retained sliding motion of said movable anchor carriage relative to said support means.

11. An anchor and anchor retriever assembly for deploying an anchor from a boat into the water and retrieving the anchor from the water, said assembly including a releasable anchor having a central body portion, releasable outwardly extending arms and a central rod, and an anchor cable secured to said central rod, wherein the improvement comprises:

support means adapted for attachment of the anchor retriever to a portion of a boat; and a movable anchor carriage slidably received by said support means and movable between an anchor-deployed orientation and an anchor-stowed orientation, said movable anchor carriage including a pivotal anchor holder which is oriented in a first position when said movable anchor carriage is in said anchor-deployed orientation and in a second position which is substantially perpendicular to said first position when said movable anchor carriage is in said anchor-stowed orientation, said pivotal anchor holder includes a top abutment member, a lower sleeve having an abutment edge and spring means disposed therebetween, said top abutment member and said lower sleeve being disposed cooperatively one with respect to the other such that the effective distance between the top abutment member and the abutment edge is increasable by extension of said spring means.

12. The assembly of claim 11 wherein said top abutment member contacts the central body portion of said anchor and the abutment edge contacts the central body portion of the anchor arms such that an effective increase in length between the two abutment locations is necessary for the arms to collapse.

13. An anchor retriever for deploying an anchor from a boat into the water, the anchor being tied to an anchor cable, and for retrieving the anchor from the water by means of said cable, said retriever comprising:

a base portion adapted for attachment to the boat, said base portion includes an attachment plate adapted for attachment to the boat and a guide plate secured thereto;

a movable carriage slidably received on said base portion;

stop means cooperatively arranged relative to said movable carriage such that the carriage is movable between a first stop location and a second stop location; and an anchor retention assembly pivotally attached to said movable carriage and movable between an anchor-stowed orientation which corresponds to said first stop location and an anchor-deployed orientation which corresponds to said second stop location, said anchor retention assembly includes:

anchor holder means adapted for the anchor cable to pass therethrough;

latch means assembled to said anchor holder means and adapted to interlock with said movable carriage when said anchor retention assembly is in said anchor-deployed orientation; and, pivot attachment means assembled between said movable carriage and said anchor holder means and adapted to allow said anchor holder means to pivot from a first orientation when said anchor retention assembly is in said anchor-deployed orientation to a second orientation which is substantially perpendicular to said first orientation, said second orientation corresponding to said anchor-stowed orientation.

14. An anchor retriever for deploying an anchor from a boat into the water, the anchor being tied to an anchor cable, and for retrieving the anchor from the water by means of said cable, said retriever comprising:

a base portion adapted for attachment to the boat;

a movable carriage slidably received on said base portion;

stop means cooperatively arranged relative to said movable carriage such that the carriage is movable between a first stop location and a second stop location;

an anchor retention assembly pivotally attached to said movable carriage and movable between an anchor-stowed orientation which corresponds to said first stop location and an anchor-deployed orientation which corresponds to said second stop location, said anchor retention assembly includes:

anchor holder means adapted for the anchor cable to pass therethrough;

latch means assembled to said anchor holder means and adapted to interlock with said movable carriage when said anchor retention assembly is in said anchor-deployed orientation; and, pivot attachment means assembled between said movable carriage and said anchor holder means and adapted to allow said anchor holder means to pivot from a first orientation when said anchor retention assembly is in said anchor-deployed orientation to a second orientation which is substantially perpendicular to said first orientation, said second orientation corresponding to said anchor-stowed orientation;

a lock means for locking said movable carriage in said anchor deployed orientation, said lock means including a lever and a spring means for biasing said lever in a locking orientation which unidirectionally inhibits relative motion between said movable carriage and said guide plate when said movable carriage is in said anchor deployed orientation; and, said base portion including an attachment plate adapted for attachment to the boat and a guide plate secured thereto, said guide plate having a pair of oppositely disposed, longitudinally extending first guide members and said movable carriage having a pair of oppositely disposed, longitudinally extending second guide members, said first and second guide members being cooperatively received, one within the other, for providing a retained sliding motion of said movable carriage relative to said guide plate.

15. The anchor retriever of claim 14 wherein said lever is pivotally mounted to said movable carriage and includes a first end which engages said guide plate when said lever is in a locked orientation thereby preventing relative movement of said movable carriage and said guide plate.

16. The anchor retriever of claim 15 wherein said lever has a second end which protrudes above said movable carriage when said movable carriage is in said anchor-deployed orientation, said second end being depressable by said anchor retention assembly when said anchor retention assembly is in said anchor-stowed orientation, depression of said second end causing said first end to no longer engage said guide plate thereby allowing relative movement of said movable carriage and said guide plate.

17. An anchor retriever for deploying an anchor from a boat into the water, the anchor being tied to an anchor cable, and for retrieving the anchor from the water by means of said cable, said retriever comprising:

a base portion adapted for attachment to the boat;

a movable carriage slidably received on said base portion;

stop means cooperatively arranged relative to said movable carriage such that the carriage is movable between a first stop location and a second stop location;

an anchor retention assembly pivotally attached to said movable carriage and movable between an anchor-stowed orientation which corresponds to said first stop location and an anchor-deployed orientation which corresponds to said second stop location; and said anchor retention assembly includes anchor holder means adapted for the anchor cable to pass therethrough and latch means assembled to said anchor holder means and adapted to interlock with said movable carriage when said anchor retention assembly is in said anchor-deployed orientation.

18. An anchor and anchor retriever assembly for deploying an anchor from a boat into the water and retrieving the anchor from the water, said assembly including a releasable anchor having a central body portion, releasable outwardly extending arms and a central rod, and an anchor cable secured to said central rod, wherein the improvement comprises:

support means adapted for attachment of the anchor retriever to a portion of a boat, said support means includes an attachment plate designed and arranged for directly attaching to the boat and assembled thereto a guide plate providing a pair of oppositely disposed channels; and a movable anchor carriage slidably received by said support means and movable between an anchor-deployed orientation and an anchor-stowed orientation, said movable anchor carriage including a pivotal anchor holder which is oriented in a first position when said movable anchor carriage is in said anchor-deployed orientation and in a second position which is substantially perpendicular to said first position when said movable anchor carriage is in said anchor-stowed orientation; and, lock means for locking said movable carriage in said anchor deployed orientation, said lock means including a lever and a spring means for biasing said lever in a locking orientation which unidirectionally inhibits relative motion between said movable carriage and said support means when said movable carriage is in said anchor deployed orientation.

19. An anchor and anchor retriever assembly for deploying an anchor from a boat into the water and retrieving the anchor from the water, said assembly including a releasable anchor having a central body portion, releasable outwardly extending arms and a central rod, and an anchor cable secured to said central rod, wherein the improvement comprises:

support means adapted for attachment of the anchor retriever to a portion of a boat;

a movable anchor carriage slidably received by said support means and movable between an anchor-deployed orientation and an anchor-stowed orientation, said movable anchor carriage including a pivotal anchor retention assembly which is oriented in a first position when said movable anchor carriage is in said anchor-deployed orientation and in a second position which is substantially perpendicular to said first position when said movable anchor carriage is in said anchor-stowed orientation, said anchor retention assembly includes:

anchor holder means adapted for the anchor cable to pass therethrough;

latch means assembled to said anchor holder means and adapted to interlock with said movable carriage when said anchor retention assembly is in said anchor-deployed orientation; and, pivot attachment means assembled between said movable carriage and said anchor holder means and adapted to allow said anchor holder means to pivot from a first orientation when said anchor retention assembly is in said anchor-deployed orientation to a second orientation which is substantially perpendicular to said first orientation, said second orientation corresponding to said anchor-stowed orientation; and said support means including an attachment plate designed and arranged for directly attaching to the boat and assembled thereto a guide plate providing a pair of oppositely disposed, longitudinally extending first guide members and said movable anchor carriage having a pair of oppositely disposed, longitudinally extending second guide members, said first and second guide members being cooperatively received, one within the other, for providing a retained sliding motion of said movable anchor carriage relative to said guide plate.

* * * * *